US007708066B2

(12) United States Patent
Frazier

(10) Patent No.: US 7,708,066 B2
(45) Date of Patent: May 4, 2010

(54) FULL BORE VALVE FOR DOWNHOLE USE

(76) Inventor: W. Lynn Frazier, 713 Snug Harbor, Corpus Christi, TX (US) 78402

( * ) Notice: Subject to any disclaimer, the term of this patent is extended or adjusted under 35 U.S.C. 154(b) by 95 days.

(21) Appl. No.: 12/130,840

(22) Filed: May 30, 2008

(65) Prior Publication Data

US 2009/0159274 A1 Jun. 25, 2009

Related U.S. Application Data

(60) Provisional application No. 61/016,323, filed on Dec. 21, 2007.

(51) Int. Cl.
*E21B 34/14* (2006.01)

(52) U.S. Cl. ..... 166/250.08; 166/332.8; 166/334.1

(58) Field of Classification Search ..... 166/332.8, 166/334.1, 250.08, 317; 251/298, 228, 343
See application file for complete search history.

(56) References Cited

U.S. PATENT DOCUMENTS 2,368,428 A 1/1945 Saurenman
2,853,265 A * 9/1958 Clark, Jr. ..... 251/106
2,874,927 A * 2/1959 Conrad ..... 251/100
3,159,217 A * 12/1964 Hanson ..... 166/260
3,275,080 A 9/1966 Nelson et al.
3,289,762 A 12/1966 Schell et al.
3,289,769 A 12/1966 Nelson et al.
3,292,707 A 12/1966 Nelson et al.
3,526,278 A * 9/1970 Scott ..... 166/152
3,606,923 A * 9/1971 Berryman ..... 166/125
3,995,692 A 12/1976 Seitz
4,122,898 A * 10/1978 Nelson ..... 166/325
4,134,455 A 1/1979 Read
4,427,071 A 1/1984 Carmody
4,444,266 A 4/1984 Pringle
4,457,376 A 7/1984 Carmody et al.
4,478,286 A 10/1984 Fineberg
4,583,596 A 4/1986 Davis
4,637,468 A 1/1987 Derrick
4,694,903 A 9/1987 Ringgenberg
4,813,481 A 3/1989 Sproul et al.
5,012,867 A 5/1991 Kilgore
5,137,090 A 8/1992 Hare et al.
5,188,182 A 2/1993 Echols, III et al.
5,564,502 A 10/1996 Crow et al.
5,924,696 A 7/1999 Frazier
6,196,261 B1 3/2001 Dennistoun
6,227,299 B1 5/2001 Dennistoun
6,328,109 B1 12/2001 Pringle et al.

(Continued)

*Primary Examiner*—Shane Bomar
(74) *Attorney, Agent, or Firm*—Edmonds & Nolte, P.C.

(57) ABSTRACT

Downhole tools and methods for producing hydrocarbons from a wellbore. A downhole tool can include a body having a bore formed therethrough and at least one end adapted to threadably engage one or more tubulars. A sliding sleeve, adapted to move between a first position and a second position within the body, can be at least partially disposed within the body. A valve assembly including a valve member having an arcuate cross section wherein the valve member is adapted to pivot between an open and closed position within the body can be disposed within the body. A valve seat, having an arcuate cross-section adapted to provide a fluid tight seal with the valve member assembly can be disposed within the body.

20 Claims, 11 Drawing Sheets

U.S. PATENT DOCUMENTS 6,328,112 B1 12/2001 Malone
6,386,288 B1 5/2002 Snider et al.
6,394,187 B1 5/2002 Dickson et al.
6,536,524 B1 3/2003 Snider
6,543,538 B2 4/2003 Tolman et al.
6,575,249 B2 6/2003 Deaton
6,666,271 B2 12/2003 Deaton et al.
6,684,950 B2 * 2/2004 Patel ..... 166/250.01
6,732,803 B2 5/2004 Garcia et al.
6,808,020 B2 10/2004 Garcia et al.
6,851,477 B2 2/2005 Hill, Jr. et al.
7,063,156 B2 * 6/2006 Patel et al. ..... 166/332.8
7,086,481 B2 8/2006 Hosie et al.
7,287,596 B2 10/2007 Frazier et al.
7,537,062 B2 * 5/2009 Hughes et al. ..... 166/386
2002/0125011 A1 9/2002 Snider
2003/0047315 A1 3/2003 Allamon
2005/0087335 A1 4/2005 Vick, Jr.
2006/0048936 A1 3/2006 Fripp et al.
2006/0070744 A1 4/2006 Smith
2006/0124310 A1 6/2006 Lopez de Cardenas et al.
2006/0124311 A1 6/2006 Lopez de Cardenas et al.
2006/0124315 A1 6/2006 Frazier et al.

* cited by examiner

FULL BORE VALVE FOR DOWNHOLE USE

REFERENCE TO RELATED APPLICATIONS

This application claims benefit of U.S. Provisional Patent Application having Ser. No. 61/016,323, filed on Dec. 21, 2007, which is incorporated by reference herein.

BACKGROUND OF THE INVENTION

1. Field of the Invention

Embodiments of the present invention generally relate to downhole tools and methods for using same. More particularly, embodiments of the present invention relate to a full bore flapper valve for a downhole tool and methods for using same.

2. Description of the Related Art

A wellbore typically penetrates multiple hydrocarbon bearing intervals, each requiring independent perforation and fracturing prior to being placed into production. Multiple plugs are often employed to isolate the individual hydrocarbon bearing intervals, thereby permitting the independent treatment of each interval with minimal impact to other intervals within the wellbore. This has been accomplished using one or more bridge plugs to isolate one or more lower intervals, thereby permitting the treatment of the one or more intervals above the plug. This process is repeated until all of the desired intervals have been treated. After treatment of each hydrocarbon bearing interval, the bridge plugs between the intervals are removed, typically by drilling and/or milling, permitting hydrocarbons to flow bi-directionally within the casing, preferably up-hole to the surface for recovery and collection. The repeated setting and removal of plugs within the wellbore is a time consuming and costly process that requiring multiple run-ins to place and remove the one or more downhole plugs and/or tools.

Plugs with check valves can eliminate the need to drill or mill conventional bridge plugs within the casing string, thereby minimizing the number of run-ins required and permitting more rapid production after perforating and fracing a hydrocarbon bearing interval. U.S. Pat. Nos. 4,427,071; 4,433,702; 4,531,587; 5,310,005; 6,196,261; 6,289,926; and 6,394,187 provide additional information on such plugs. Check valves, while minimizing run-in and run-out of tools into the casing string, have several drawbacks. First, the installation of check valves places one or more multi-piece assemblies downhole; these assemblies are prone to fouling by production fluids, potential mechanical failure due to damage from the passage of downhole tools, and/or chemical attack from routine wellbore operations. Second, the use of a check valve requires a complimentary valve seat disposed within the wellbore, proximate to the check valve. Constraints within the casing string often require the valve seat to have a smaller diameter or bore than the adjoining casing string, thereby limiting the passage of tools through the check valve and increasing the pressure drop through the tool.

There is a need, therefore, for a check-valve isolation tool permitting the isolation of one or more hydrocarbon bearing intervals, while minimizing the pressure drop through the tool and providing the maximum available open diameter for the passage of downhole tools.

SUMMARY OF THE INVENTION

Downhole tools for producing hydrocarbons from a wellbore are provided. A downhole tool can include a body having a bore formed therethrough and at least one end adapted to threadably engage one or more tubulars. A sliding sleeve, adapted to move between a first position and a second position within the body, can be at least partially disposed within the body. A valve assembly including a valve member having an arcuate cross section wherein the valve member is adapted to pivot between an open and closed position within the body can be disposed within the body. A valve seat, having an arcuate cross-section adapted to provide a fluid tight seal with the valve member assembly can be disposed within the body.

Methods for the testing of a well are also provided. A casing string containing one or more downhole tools can be placed within a wellbore. When initially introduced to the wellbore, the one or more tools can be in a run-in ("first" or "open") position wherein bi-directional fluid communication through the tool can occur. The wellbore can be stabilized after installing the casing string by pumping cement through the casing string to fill the annular area between the wellbore and the exterior of the casing string. After the cement has cured, the casing string can be pressure tested using a hydraulic or pneumatic fluid. After testing, the cement surrounding the second, downhole, end of the casing string can be fractured using hydraulic pressure. The sliding sleeve in the next lowermost tool can be displaced, permitting the movement of the valve assembly therein to an operating ("second" or "closed") position. The casing string above the tool can be pressure tested. In similar fashion, any number of check valve isolation tools within a single wellbore can be displaced prior to pressure testing all or a portion of the casing string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
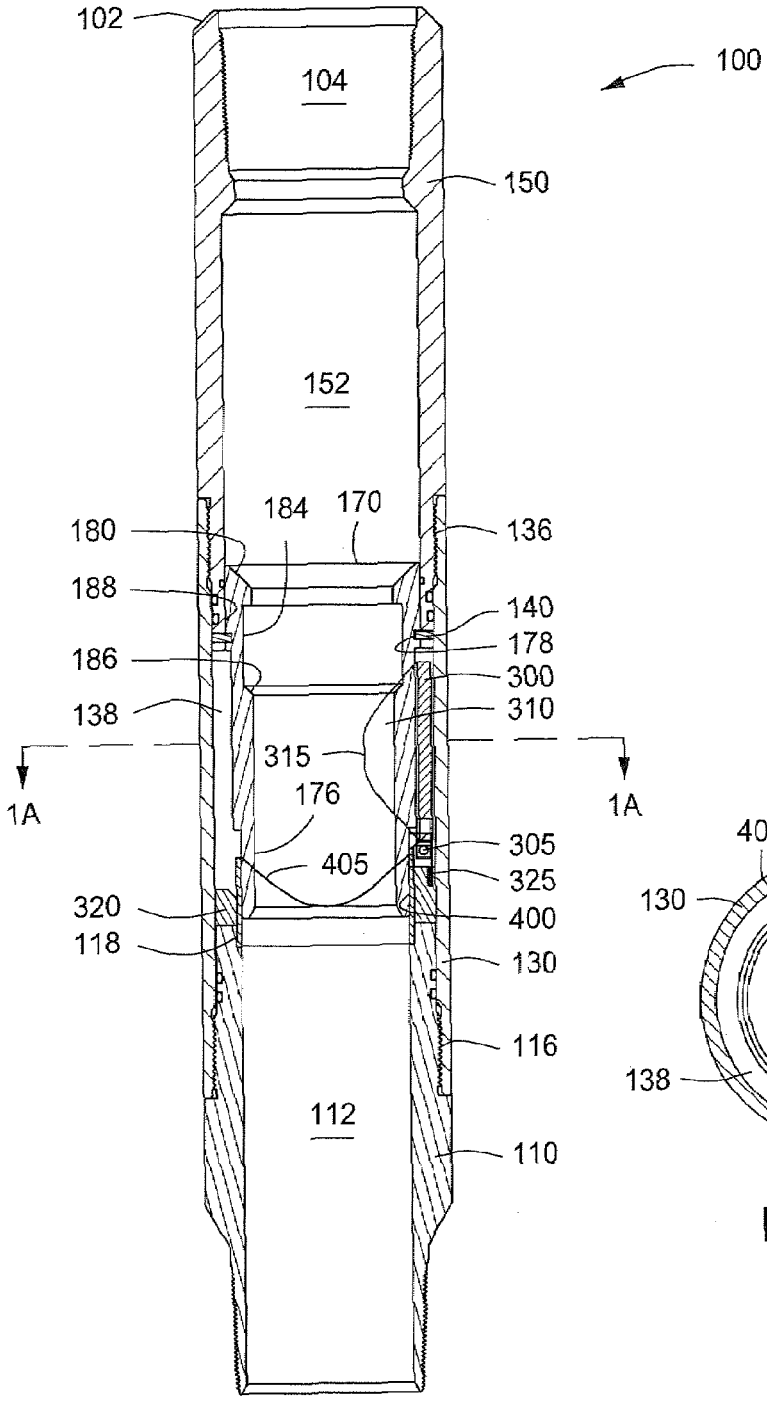
FIG. 1 depicts a partial cross sectional view of an illustrative tool in a first, "run-in," position according to one or more embodiments described.

FIG. 1 depicts a partial cross sectional view of an illustrative tool 100 in a run-in ("first" or "open") position according to one or more embodiments. In one or more embodiments, the tool 100 can include a body 102 having a bore 104 formed therethrough; at least one sliding sleeve 170; at least one valve assembly 300; and at least one valve seat assembly 400. The sliding sleeve 170, the valve assembly 300, and the valve seat assembly 400 can be disposed within the body 102. The body 102 can contain two or more threadably interconnected sections, three are shown, a lower sub-assembly ("lower-sub") 110, a valve body 130, and an upper sub-assembly ("upper-sub") 150. The sections, including one or more valve bodies and one or more sub-assemblies, can be disposed in any order, configuration, and/or arrangement. In one or more specific embodiments, as depicted in FIG. 1, the lower-sub 110 can be disposed about a first, lower, end of the valve body 130 and the upper-sub 150 can be disposed about a second, upper, end of the valve body 130.

In one or more embodiments, the valve assembly 300 can be at least partially disposed within the valve body 130. The valve assembly 300 can include one or more pivot pins 305, valve members 310, valve holders 320, and one or more springs 325. The valve member 310 can have an arcuate shape, with a convex upper surface and a concave lower surface. A sealing surface 315 can be disposed on the lower surface of the valve member 310. The valve member 310 can be pivotably attached to the valve holder 320 using the one or more pivot pins 305. In one or more embodiments, the valve holder 320 can be disposed concentrically within the valve body 130. In one or more embodiments, the spring 325 can be disposed about the one or more pivot pins 305 to urge the valve member 310 from the run-in position wherein the valve member 310 does not obstruct the bore through the tool 100, to an operating ("second" or "closed") position wherein the valve member 310 assumes a position proximate to the valve seat 400, transverse to the bore of the tool 100. In one or more embodiments, at least a portion of the spring 325 can be disposed upon or across the upper surface of the valve member 310 providing greater contact between the spring 325 and the valve member 310, offering greater leverage for the spring 325 to displace the valve member 310 from the run-in position to the operating position. In the run-in position, bi-directional, e.g. upward and downward or side to side, fluid communication through the tool 100 can occur. In the operating position, unidirectional, e.g. upward, left to right, or right to left, fluid communication through the tool 100 can occur.

As used herein the term "arcuate" refers to any body or member having a cross-section forming an arc. For example, a flat, elliptical member with both ends along the major axis turned downwards by an equivalent amount can form an arcuate member.

The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses.

In one or more embodiments, the valve seat assembly 400 can be at least partially disposed within the valve body 130. In one or more embodiments, the valve seat assembly 400 can be located in a fixed position within the valve body 130, disposed concentrically within the valve holder 320. Although not shown in FIG. 1, in one or more embodiments, the valve seat assembly 400 and the valve holder 320 can be pinned or otherwise permanently attached such that the valve seat assembly 400 can remain at a fixed location relative to the tool body 100, the valve body 130, and the valve assembly 300. In one or more embodiments, the second, upper, end of the valve seat assembly 400 can define an arcuate valve seat 405, which can provide a complimentary arcuate shape to the sealing surface 315 of the valve member 310.

In one or more embodiments, the sliding sleeve 170 can be an axially displaceable member having a bore or flowpath formed therethrough, concentrically disposed within the tool body 102. In one or more embodiments, an inner surface 184 of the sliding sleeve 170 can include a first shoulder 180 to provide a profile for receiving an operating element of a conventional design setting tool, known to those of ordinary skill in the art. The sliding sleeve 170 can be temporarily fixed in place within the upper-sub 150 using one or more shear pins 140, each disposed through an aperture on the upper-sub 150, and seated in a mating recess 178 on the outer surface of the sliding sleeve 170. The valve body 130 can be disposed about, and threadedly connected to, the upper-sub 150 thereby trapping the sliding sleeve 170 concentrically within the bore of the tool body 102 and the upper-sub 150 and providing an open bore or flowpath therethrough.

In one or more embodiments, a shoulder 188 can be disposed about an outer circumference of the sliding sleeve 170. The shoulder 188 can have an outside diameter less than the corresponding inside diameter of the upper-sub 150. Although not shown in FIG. 1, in one or more embodiments, the shoulder 188 can have one or more external, peripheral, circumferential grooves with one or more O-ring or other elastomeric seals disposed therein, providing a liquid-tight seal between the sliding sleeve 170 and the upper-sub 150. In one or more embodiments, the outer surface of the shoulder 188 proximate to the upper-sub 150 can have a roughness of about 0.1 μm to about 3.5 μm Ra.

In one or more embodiments, a first end 176 of the sliding sleeve 170 can have an outside diameter less than the bore or flowpath through the valve seat assembly 400. As depicted in FIG. 1, when the valve assembly 300 is in the run-in position, the first end 176 of the sliding sleeve 170 can be disposed concentrically within the valve seat assembly 400. Although not shown in FIG. 1, the first end 176 of the sliding sleeve 170 can have one or more external, circumferential grooves with one or more O-ring or other sealing elements disposed therein, providing a fluid-tight seal between the first end 176 of the sliding sleeve 170 and the valve seat assembly 400.

Figure 1A:
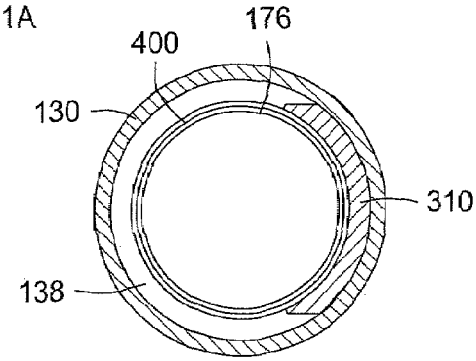
FIG. 1A depicts a cross-sectional view of the illustrative tool depicted in FIG. 1 along line 1A-1A.

FIG. 1A depicts a cross-sectional view of the illustrative tool depicted in FIG. 1 along line 1A-1A. In one or more embodiments, while in the run-in position, a lower portion 176 of the sliding sleeve 170 can maintain the valve member 310 within an annular, i.e. ring shaped, region 138. The inner diameter of the annular region 138 can be formed by the lower portion 176 of the sliding sleeve 170 and the outer diameter of the annular region 138 can be formed by the valve body 130. As depicted in FIG. 1A, when in the run-in position, the concave, lower, surface of the valve member 310 can be proximate to the lower portion 176 of the sliding sleeve 170, while the convex, upper, surface of the valve member 310 can be proximate to the valve body 130. Thus, the arcuate, or curved, shape of the valve member 310 can maximize the open bore through the tool 100 when the valve member 310 and sliding sleeve 170 are in the run-in position as depicted in FIGS. 1 and 1A. By providing full bore passage through the tool 100 when in the run-in position, pressure drop through the tool 100 can be minimized, and the passage of full bore downhole tools, hydrocarbons, and/or production fluids through the tool permitted.

Figure 2:
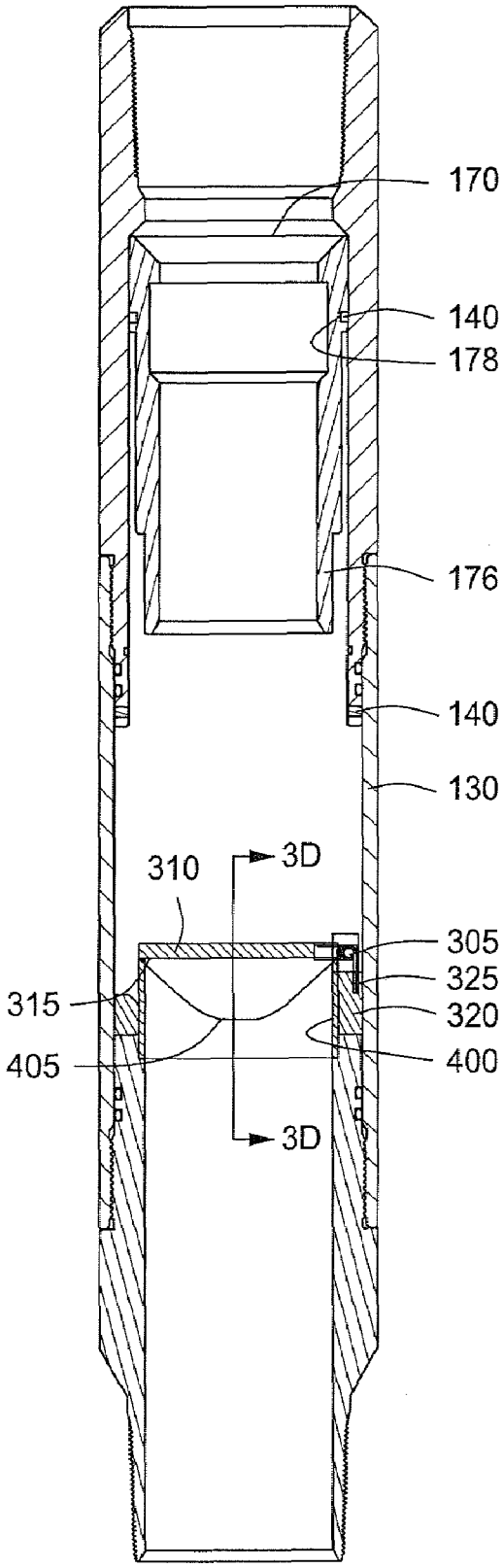
FIG. 2 depicts a partial cross sectional view of the illustrative tool in a second, "operating," position according to one or more embodiments described.

FIG. 2 depicts a partial cross sectional view of the illustrative tool 100 in the operating position according to one or more embodiments. As depicted in FIG. 2, the sliding sleeve 170 can be displaced in an upward direction, exposing both the valve assembly 300 and valve seat assembly 400. The sliding sleeve 170 can be upwardly displaced, permitting the valve member 310, urged by the one or more springs 325, to pivot through an arc of approximately 90 degrees in the opposite, downward, direction into the closed position proximate to the valve seat assembly 400. In the operating position, the sealing surface 315 of the valve member 310 can be proximate to the valve seat 405, forming a liquid-tight seal therebetween.

Figure 3B:
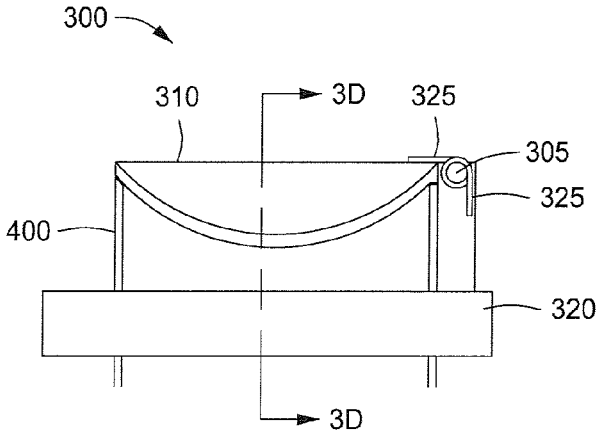
FIG. 3B depicts a side ("elevation") view of an illustrative valve assembly according to one or more embodiments described.
Figure 3A:
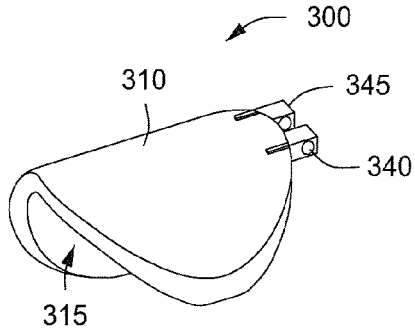
FIG. 3A depicts a 45 degree overhead orthogonal view of an illustrative valve member according to one or more embodiments described.

FIG. 3A depicts a 45 degree overhead orthogonal view of an illustrative valve member 310 according to one or more embodiments. In one or more embodiments, the valve member 310 can have an arcuate, or curved, shape with parallel, curved, upper and lower surfaces. In one or more embodiments, a sealing surface 315 can be disposed upon the lower surface of the valve member 310. One or more hinge extensions 345, each having one or more apertures 340 adapted to receiving one or more pivot pins 305 can extend from the valve member 310. In one or more embodiments, the one or more hinge extensions 345 can be disposed about the perimeter of the valve member 310.

In one or more embodiments, the valve member 310 can be fabricated using a material soluble in water, acids, bases, polar solvents, non-polar solvents, organic solvents, mixtures thereof, and/or combinations thereof. In one or more embodiments, the valve member 310 can be fabricated using a frangible material including, but not limited to engineered plastics, ceramics, cast iron, cast aluminum, or any combination thereof. In one or more embodiments, the valve member 310 can be fabricated from a thermally degradable material.

FIG. 3B depicts a side ("elevation") view of an illustrative valve assembly 300, according to one or more embodiments. In one or more embodiments, the valve member 310 can be mounted in the valve holder 320 using a pivot pin 305 and one or more springs 325. In one or more embodiments, the one or more springs 325 can be helical extension springs configured such that tension within the spring 325 can urge, or bias, the valve member 310 to the operating position, as depicted in FIG. 3B.

Figure 3C:
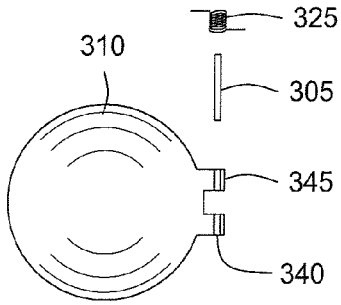
FIG. 3C depicts a knockdown view of the illustrative valve member according to one or more embodiments described.

FIG. 3C depicts a knockdown view of the illustrative valve member according to one or more embodiments. In one or more embodiments, the spring 325 can be disposed about the one or more pivot pins 305.

Figure 3D:
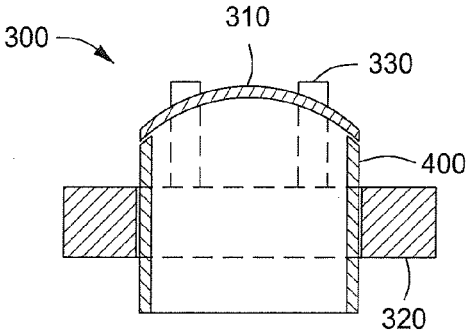
FIG. 3D depicts a cross-sectional view of an illustrative valve assembly as depicted in FIG. 3B along line 3D-3D.

FIG. 3D depicts a cross-sectional view of an illustrative flapper valve assembly 300 as depicted in FIG. 3B along line 3D-3D. In one or more embodiments, as depicted, the sealing surface 315 can be disposed on a portion of the bottom surface of the valve member 310. FIG. 3D depicts the physical relationship between the valve member 310, sealing surface 315 and valve seat 400, when the valve member 310 is in the operating position, transverse to the flowpath through the tool 100.

As depicted in FIG. 3D, the angle of contact between the valve member 310 and the valve seat 405 can vary with respect to the longitudinal centerline of the tool 100. In one or more embodiments, the angle of the interface between the valve member 310 and the valve seat 405 measured with respect to the longitudinal centerline of the tool 100 can range from about 1° to about 89°; from about 20° to about 60°; or from about 30° to about 50°. In one or more embodiments, the valve seat 405 can be suitably beveled and/or chamfered to provide a liquid-tight seal when the valve member 310 is closed and the sealing surface 315 is disposed proximate to the valve seat 405.

Figure 3E:
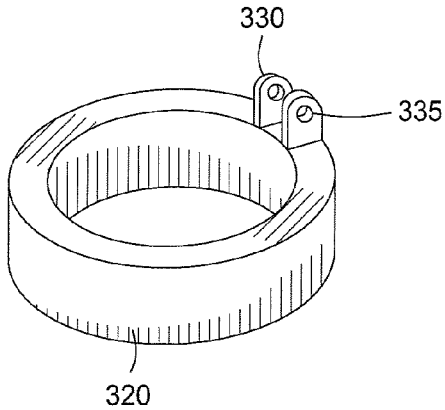
FIG. 3E depicts a 45 degree overhead orthogonal view of an illustrative valve holder according to one or more embodiments described.

FIG. 3E depicts a 45 degree overhead orthogonal view of an illustrative valve holder 320 according to one or more embodiments. In one or more embodiments, the valve holder 320 can be an annular, i.e. ring shaped, member with one or more hinge extensions 330, each containing one or more apertures 335 for the insertion of the one or more pivot pins 305.

Figure 4A:
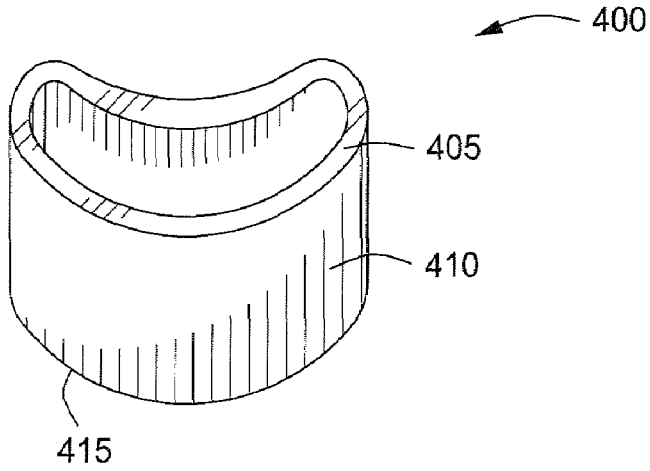
FIG. 4A depicts a 45 degree overhead orthogonal view of an illustrative valve seat according to one or more embodiments described.

FIG. 4A depicts a 45 degree overhead orthogonal view of an illustrative valve seat assembly 400 according to one or more embodiments described. In one or more embodiments, the valve seat assembly 400 can be a hollow member 410 defining an annular bore therethrough and have a first ("lower") end 415 and a second ("upper") end. In one or more embodiments, the second end can define a valve seat 405, complimentary in shape to the sealing surface 315 of the valve member 310, such that when the sealing surface 315 is proximate to the valve seat 405, a liquid-tight seal can be formed therebetween. In one or more embodiments, the valve seat assembly 400 and/or valve seat 405 can be fabricated using one or more non-elastomeric materials, including, but not limited to, aluminum, steel, cast iron or other metal alloys. In one or more embodiments, the valve seat assembly 400 and/or valve seat 405 can be partially or completely fabricated using one or more flexible materials, including, but not limited to, soft metal alloys (e.g. brass, bronze, gold), and/or elastomers such as polytetrafluoroethylene (PTFE), copolymers of hexafluoropropylene (HFP) and vinylidene fluoride (VDF or VF2), terpolymers of tetrafluoroethylene (TFE), vinylidene fluoride (VDF) and hexafluoropropylene (HFP) as well as perfluoromethylvinylether (PMVE), ethylene propylene diene monomer (EPDM), derivatives thereof, mixtures thereof or any combination thereof. In one or more embodiments, the valve seat assembly 400 and/or valve seat 405 can be fabricated using an engineered materials and/or composite materials including, but not limited to, resins, carbon fiber, ceramics, high temperature plastics, or any combination thereof.

Figure 4B:
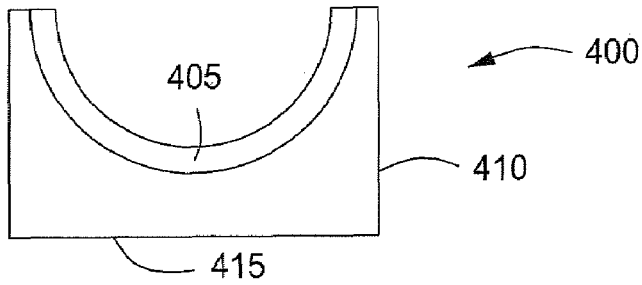
FIG. 4B depicts a side ("elevation") view of an illustrative valve seat according to one or more embodiments described.

FIG. 4B depicts a side ("elevation") view of an illustrative valve seat assembly 400 according to one or more embodiments. In one or more embodiments, the first end 415 of the hollow member 410 can be perpendicular to the longitudinal axis of the bore through the hollow member 410, while the second end can define the actuate valve seat 405 as depicted in FIG. 4A.

Figure 4C:
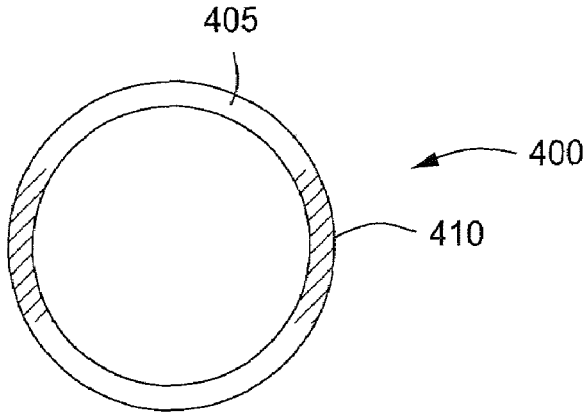
FIG. 4C depicts an overhead view of the illustrative valve seat according to one or more embodiments described.

FIG. 4C depicts an overhead view of the illustrative valve seat assembly 400 according to one or more embodiments. In one or more embodiments, the valve seat 405 located on the second end of the hollow member 410 can define a circular, or ring-shaped, annular flowpath or bore therethrough.

Figure 4D:
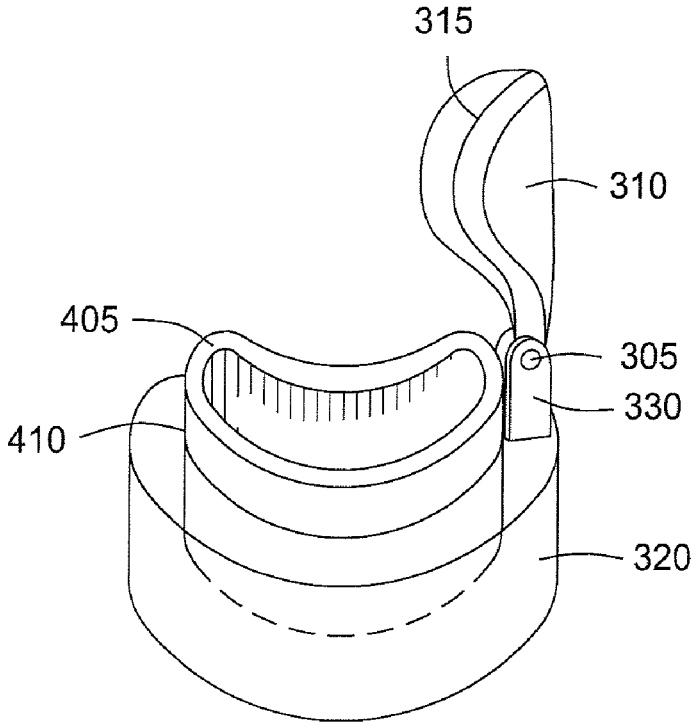
FIG. 4D depicts a 45 degree overhead orthogonal view of an illustrative valve seat and valve assembly in the run-in position according to one or more embodiments described.

FIG. 4D depicts a 45 degree overhead orthogonal view of an illustrative valve seat assembly 400 disposed within an illustrative valve assembly 300 in the run-in position according to one or more embodiments. In one or more embodiments, the valve seat assembly 400 can be concentrically disposed within the valve holder 320. In one or more embodiments, the height of the valve seat assembly 400 and the height of the one or more hinge extensions 330 can be set such that the valve member 310 can freely pivot about the pivot pin 305. In one or more embodiments, in the run-in position depicted in FIG. 4D, the flapper valve assembly 300 can be disposed at an angle of approximately 90 degrees to the valve seat assembly 400. In the run-in configuration, the valve member 310 does not interfere with, or impose upon, the flow path formed by the annular hollow member 410, the second end of which forms the valve seat 405.

Figure 4E:
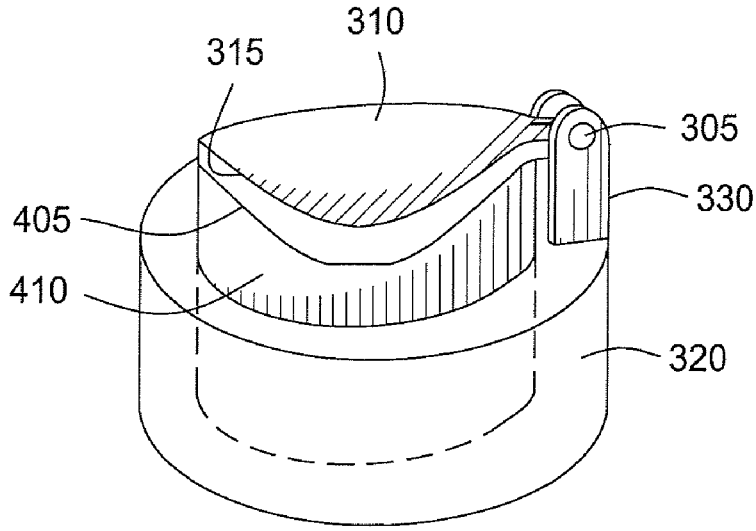
FIG. 4E depicts a 45 degree overhead orthogonal view of an illustrative valve seat and valve assembly in the operating position according to one or more embodiments described.

FIG. 4E depicts a 45 degree overhead orthogonal view of an illustrative valve seat assembly 400 disposed within an illustrative valve assembly 300 in the operating position according to one or more embodiments. In one or more embodiments, in the operating position, the valve member 310, urged by the one or more springs 325, can pivot about the one or more pivot pins 305 to a position wherein the sealing surface 315 is proximate to the valve seat 405 forming a liquid-tight seal therebetween. In the operating position, the valve member is transverse to the bore through the tool 100, thereby limiting fluid communication through the bore of the tool to a single, upward, direction. Although not shown in FIG. 4E, in one or more embodiments, one or more pins can be inserted through the flapper valve holder 320, into one or more mating recesses in the valve seat assembly 400 to prevent the valve seat assembly 400 from rotating within the valve holder 320.

Referring back to FIG. 1, the valve body 130 can have a wall thickness less than the adjoining lower-sub 110 and upper-sub 150. In one or more embodiments, the valve body 130 can define an annular region 138 having a first ("lower") end and a second ("upper") end. In one or more embodiments, the lower and/or upper ends of the valve body 130 can permit the threaded attachment of one or more casing string sections (not shown), and/or tool sections, for example the upper-sub 150, and bottom-sub 110. In one or more embodiments, one or more valve assemblies 300 and valve seat assemblies 400 can be concentrically disposed within the valve body 130. In one or more embodiments, the valve body 130 can be fabricated from any suitable material including metallic, non-metallic, and metallic/nonmetallic composite materials. In one or more embodiments, the outside diameter of the valve body 130 can range from about 1 in. (2.5 cm) to about 12 in. (30.5 cm); about 2 in. (5 cm) to about 12 in. (30.5 cm); or from about 2 in (2.5 cm) to about 10 in (25 cm). In one or more embodiments, the bottom-sub 110 can be disposed on or about a lower end of the valve body 130. In one or more embodiments, the upper-sub 150 can be disposed about a second, upper, end of the valve body 130.

In one or more embodiments, the bottom-sub 110 can define an annular space 112 having a first ("upper") end and a second ("lower") end. In one or more embodiments, the upper, second, end of the bottom-sub 110 can be threadedly connected to the first, lower, end of the valve body 130 using threads 116. In one or more embodiments, the first end of the bottom-sub 110 can be threaded to permit the attachment of one or more tool sections and/or casing string sections (not shown). In one or more embodiments, one or more O-rings or other elastomeric sealing devices (two are shown) can be disposed in one or more external circumferential grooves about the second end of the bottom-sub 110, providing a liquid-tight seal with adjoining tool sections, for example valve body 130. In one or more embodiments, the bottom-sub 110 can be fabricated from any suitable material, including metallic, non-metallic, and metallic/nonmetallic composite materials.

In one or more embodiments, the second, upper, end of the bottom-sub 110 can include a peripheral groove 118 to receive the valve seat assembly 400. When disposed within the peripheral groove 118, the valve seat assembly 400 can project beyond the second, upper, end of bottom-sub 110. In one or more embodiments, the valve assembly 300 can be disposed concentrically about the valve seat assembly 400, proximate to the second, upper, end of the lower-sub 110. The valve seat assembly 400 can project above the valve holder 320 a sufficient distance to provide a valve seat 405 for the valve member 310 when the valve member is in the second, operating, position depicted in FIG. 4E.

In one or more embodiments, the top-sub 150 can define an annular space 152, having a first ("lower") end and a second ("upper") end. In one or more embodiments, the lower end of the top-sub 150 can be threadably connected to the top end of the valve body 130 using threads 136. In one or more embodiments, the top end of the top-sub 150 can be threaded to permit the attachment of one or more tool sections and/or casing string sections (not shown). In one or more embodiments, one or more O-rings or other elastomeric sealing devices (two are shown) can be disposed in one or more grooves along an external circumference of the upper-sub 150 to provide a liquid-tight seal with adjoining tool sections, for example valve body 130. In one or more embodiments, the top sub 150 can be fabricated from any suitable material including metallic, non-metallic, and metallic/nonmetallic composite materials.

In operation, in the run-in position ("first position") depicted in FIG. 1 and FIG. 1A, the valve member 310 remains trapped in the annular region 138 formed between the lower portion 176 of the sliding sleeve 170 and the valve body section 130. While the sliding sleeve 170 is maintained in the run-in position, production and/or drilling fluids, hydrocarbons and/or downhole tools can pass bi-directionally through the open bore of the tool 100. In the run-in position the lower end 176 of the sliding sleeve 170 can be disposed within the bore formed by the valve seat assembly 400 thereby preventing fluids or other debris from entering the annular region 138, protecting both the valve member 310, pivot pin 305 and valve seat 405.

A conventional downhole shifting tool can be used to apply an axial force to the sliding sleeve 170 sufficient to shear the one or more shear pins 140 and axially displace the sleeve uphole to the operating position depicted in FIG. 2. When the sliding sleeve reaches the operating position ("second position"), the valve member 310 can pivot to the operating position proximate to the valve seat 405. Although mechanical means for moving the sliding sleeve 170 have been mentioned by way of example, the use of hydraulic or other actuation means can be equally suitable and effective for displacing the sliding sleeve 170.

When the sliding sleeve 170 is in the operating position, the sealing surface 315 of the valve member 310 contacts the valve seat 405. Higher pressure on the upper surface of the valve member 310 will tend to seat the valve member 310 more tightly against the valve seat 405, thus preventing fluid communication in a downward direction through the tool 100. The higher pressure on the lower surface of the valve member 310 can lift the valve member 310 away from the valve seat 405, thereby permitting fluid communication in an upward direction through the tool 100.

Figure 5:
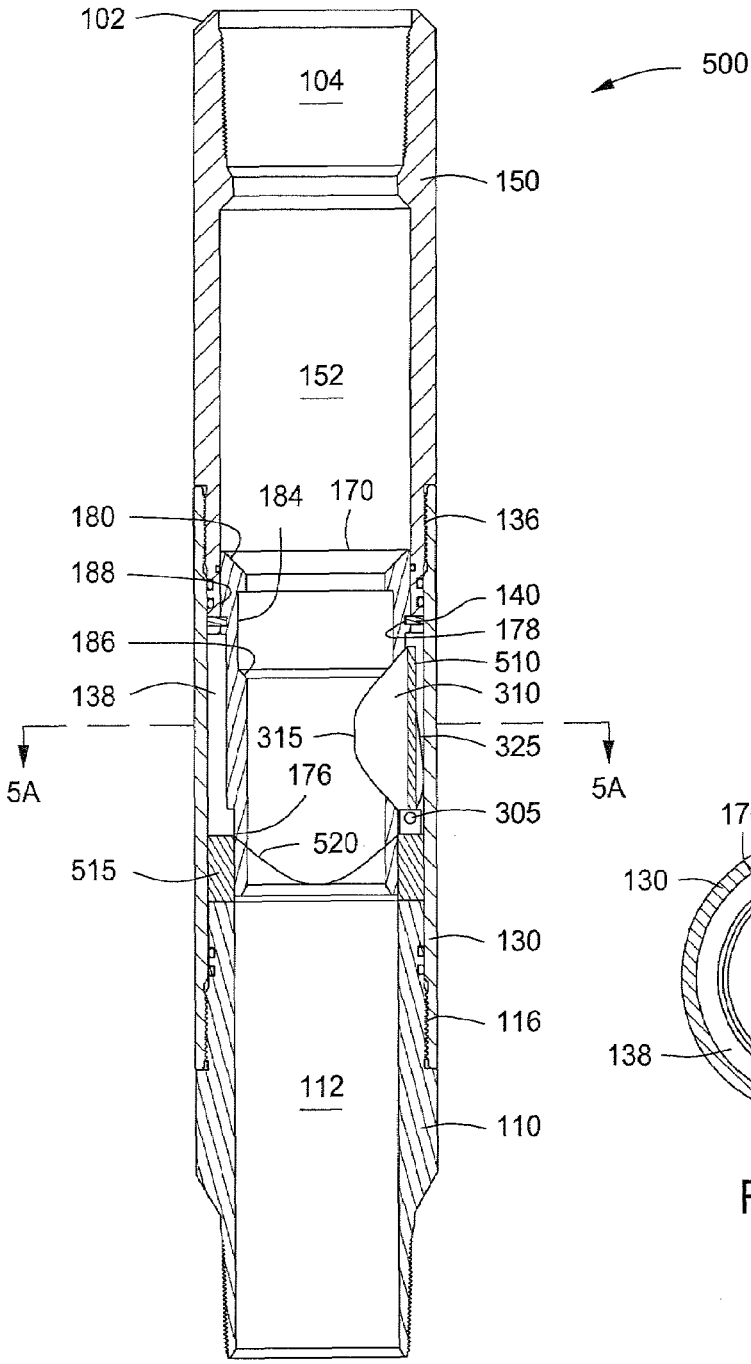
FIG. 5 depicts a partial cross sectional view of another illustrative tool in the run-in position according to one or more embodiments described.

FIG. 5 depicts a partial cross sectional view of another illustrative tool 500 in the run-in ("first" or "open") position according to one or more embodiments. Within the tool 500 the valve and valve seat assemblies (discussed in detail with respect to FIGS. 1 through 4 above) can be combined to provide a single, integrated, valve assembly 510. The valve assembly 510 can include the valve member 310 having sealing surface 315 disposed on a lower surface, the one or more pivot pins 305, the one or more springs 325, and a valve holder 515 having a valve seat 520 complimentary to the sealing surface 315 disposed on valve member 310. The valve member 310 can be attached to the valve holder 515 using one or more hinge extensions 530, each having one or more apertures 535 to accept the one or more pivot pins 305. In one or more embodiments, the valve holder 515 and/or valve seat 520 can be fabricated using one or more non-elastomeric materials, including, but not limited to, aluminum, steel, cast iron or other metal alloys. In one or more embodiments, the valve holder 515 and/or valve seat 520 can be fabricated using an engineered materials and/or composite materials including, but not limited to, resins, carbon fiber, ceramics, high temperature plastics, or any combination thereof.

Figure 5A:
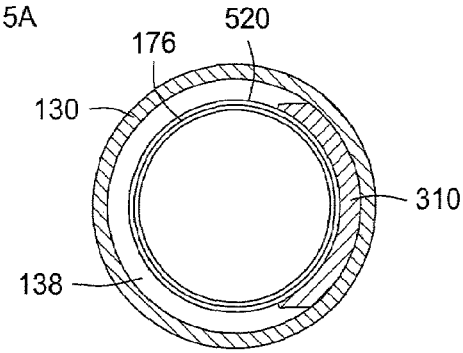
FIG. 5A depicts a cross-sectional view of the illustrative tool depicted in FIG. 5 along line 5A-5A.

FIG. 5A depicts a cross-sectional view of the illustrative tool 500 depicted in FIG. 5 along line 5A-5A according to one or more embodiments. In FIG. 5A, the valve assembly 510 is depicted in the run-in position wherein the valve member 310 can be trapped in the annular region 138 formed on the inside by the lower portion 176 of the sliding sleeve 170 and on the outside by the valve body 130.

Figure 6:
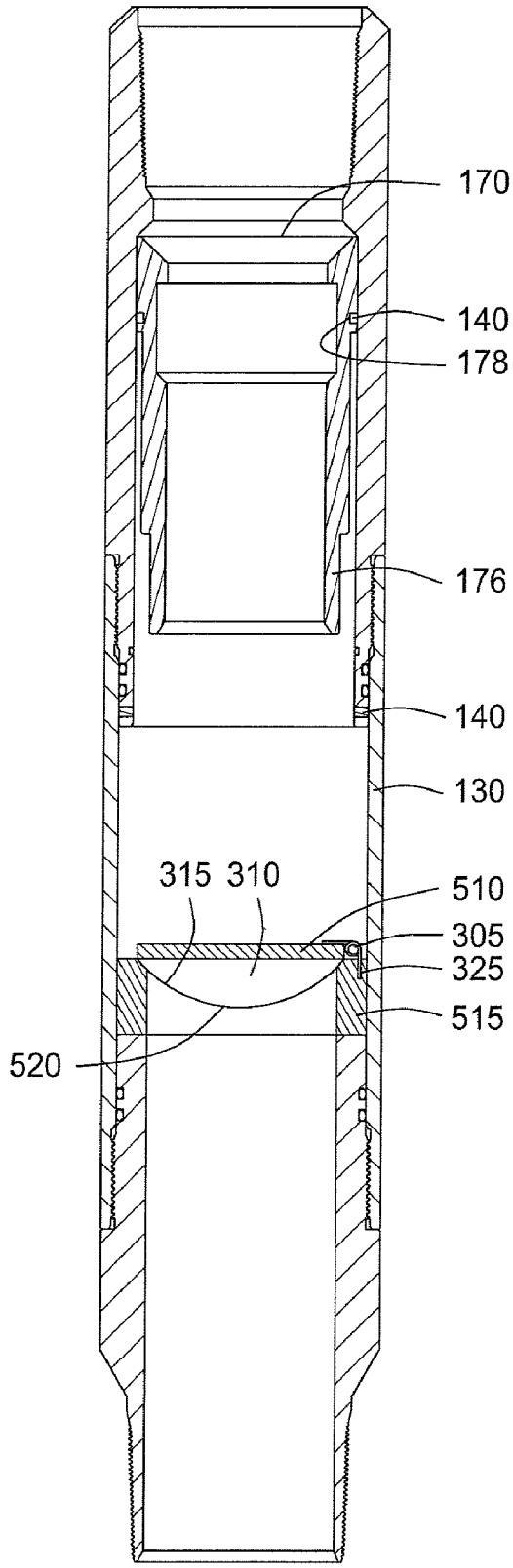
FIG. 6 depicts a partial cross sectional view of the illustrative tool in the second "operating" position according to one or more embodiments described.

FIG. 6 depicts a partial cross sectional view of the illustrative tool 500 in the operating ("second" or "closed") position according to one or more embodiments. The sliding sleeve 170 can be upwardly displaced, permitting the valve member 310, urged by the one or more springs 325, to pivot through an arc of approximately 90 degrees in the opposite, downward, direction to the closed position proximate to the valve seat 520. When in the closed position, the sealing surface 315 of the valve member 310 can be disposed proximate to the valve seat 520, forming a liquid-tight seal therebetween.

Figure 7A:
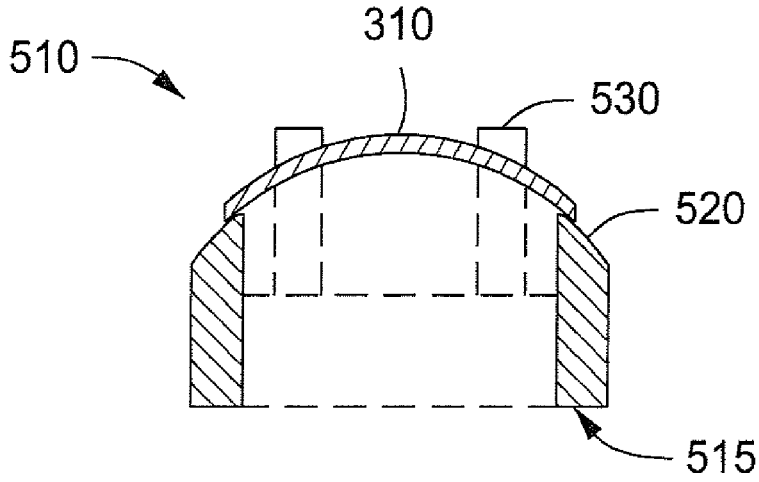
FIG. 7A depicts a cross-sectional view of the illustrative valve assembly depicted in FIG. 6 along line 7A-7A.

FIG. 7A depicts a cross-sectional view of another illustrative valve assembly 510 as depicted in FIG. 6 along line 7A-7A. In one or more embodiments, the valve member 310 can be disposed within the holder 515 using one or more pivot pins 305 (not shown) inserted through the one or more apertures 535 (also not shown) in the one or more hinge extensions 530. FIG. 7A depicts the relationship between the valve member 310, valve holder 515, and valve seat 520.

As depicted in FIG. 7A, the angle of contact between the valve member 310 and the valve seat 520 can vary with respect to the longitudinal centerline of the tool 500. In one or more embodiments, the angle of the interface between the valve member 310 and the valve seat 520 measured with respect to the longitudinal centerline of the tool 500 can range from about 1° to about 89°; from about 20° to about 60°; or from about 30° to about 50°. In one or more embodiments, the valve seat 520 can be suitably beveled and/or chamfered to provide a liquid-tight seal when the valve member 310 is closed and the sealing surface 315 is disposed proximate to the valve seat 520.

Figure 7B:
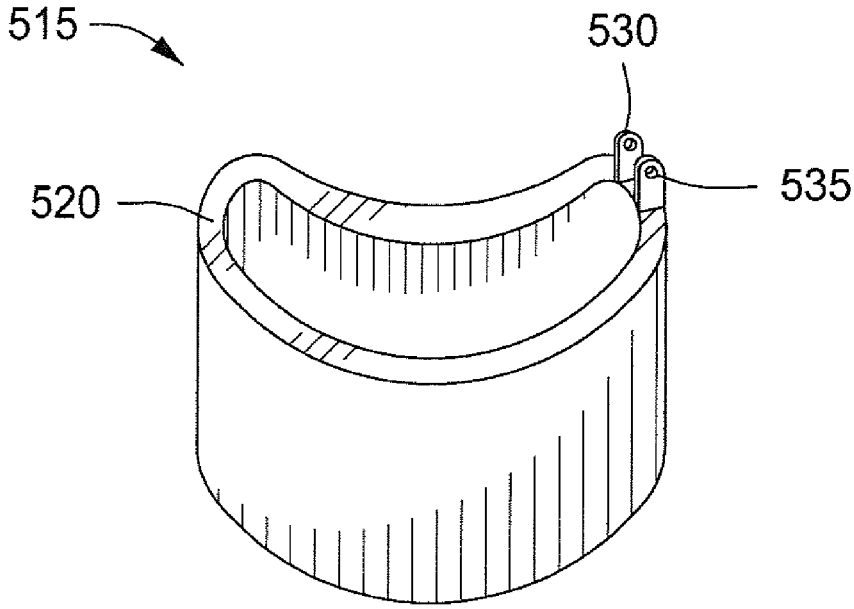
FIG. 7B depicts a 45 degree overhead orthogonal view of the illustrative valve holder depicted in FIG. 7A according to one or more embodiments described.

FIG. 7B depicts a 45 degree overhead orthogonal view of the illustrative valve holder 515 depicted in FIG. 7A according to one or more embodiments. In one or more embodiments, the valve holder 515 can be an annular (i.e. ring shaped), member with one or more hinge extensions 530, each containing one or more apertures 535 for the insertion of one or more pivot pins 305. In one or more embodiments, a first ("lower") end of the valve holder 515 can be normal (i.e. perpendicular) to the longitudinal centerline of the tool 500. In one or more embodiments, a second ("upper") end of the valve holder 515 can define an arcuate valve seat 520, which can have complimentary shape to the seating surface 315 disposed on the surface of the valve member 310 such that a liquid-tight seal can be formed between the valve seat 320 and the sealing surface 315 when the valve member 310 is disposed proximate to the valve seat 520.

Figure 8A:
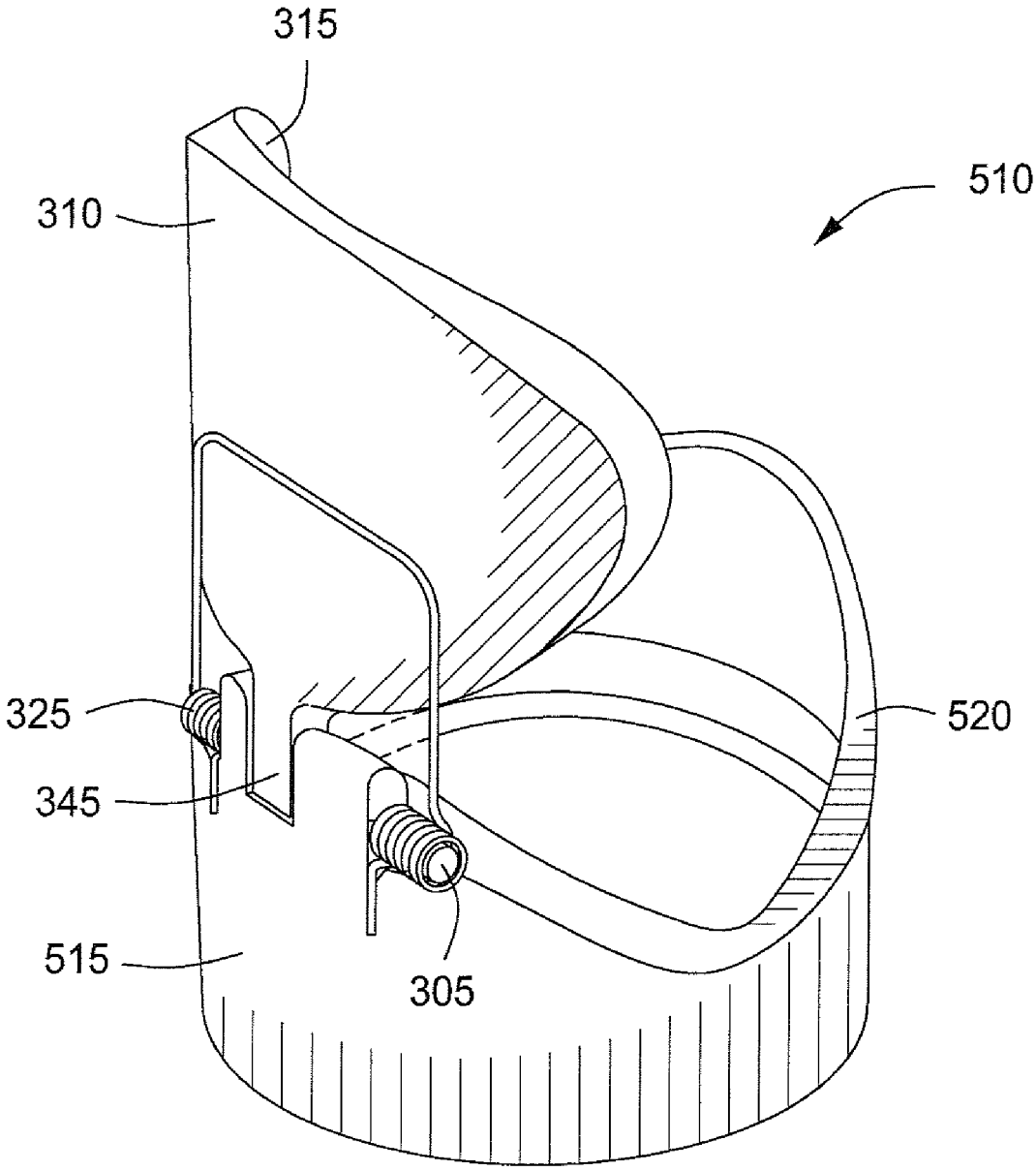
FIG. 8A depicts a 45 degree overhead orthogonal view of another illustrative valve assembly in the first, or run-in, position according to one or more embodiments described.

FIG. 8A depicts a 45 degree overhead orthogonal view of another illustrative valve assembly 510 in the first, or run-in, position according to one or more embodiments. In one or more embodiments, the lower portion 176 of the sliding sleeve 170 can maintain the valve member 310 in the position depicted in FIG. 8A during the initial run-in of the tool 500 and during downhole operations requiring the ability to flow bi-directionally through the tool 500. In one or more embodiments, the spring 325 can be a helical extension spring having an extended "tongue" portion in contact with the upper surface of the valve member 310 as depicted in FIG. 8A. While in the run-in position, the valve member 310 can be disposed at an angle of from about 80 degrees to about 90 degrees with respect to the valve seat 520.

Figure 8B:
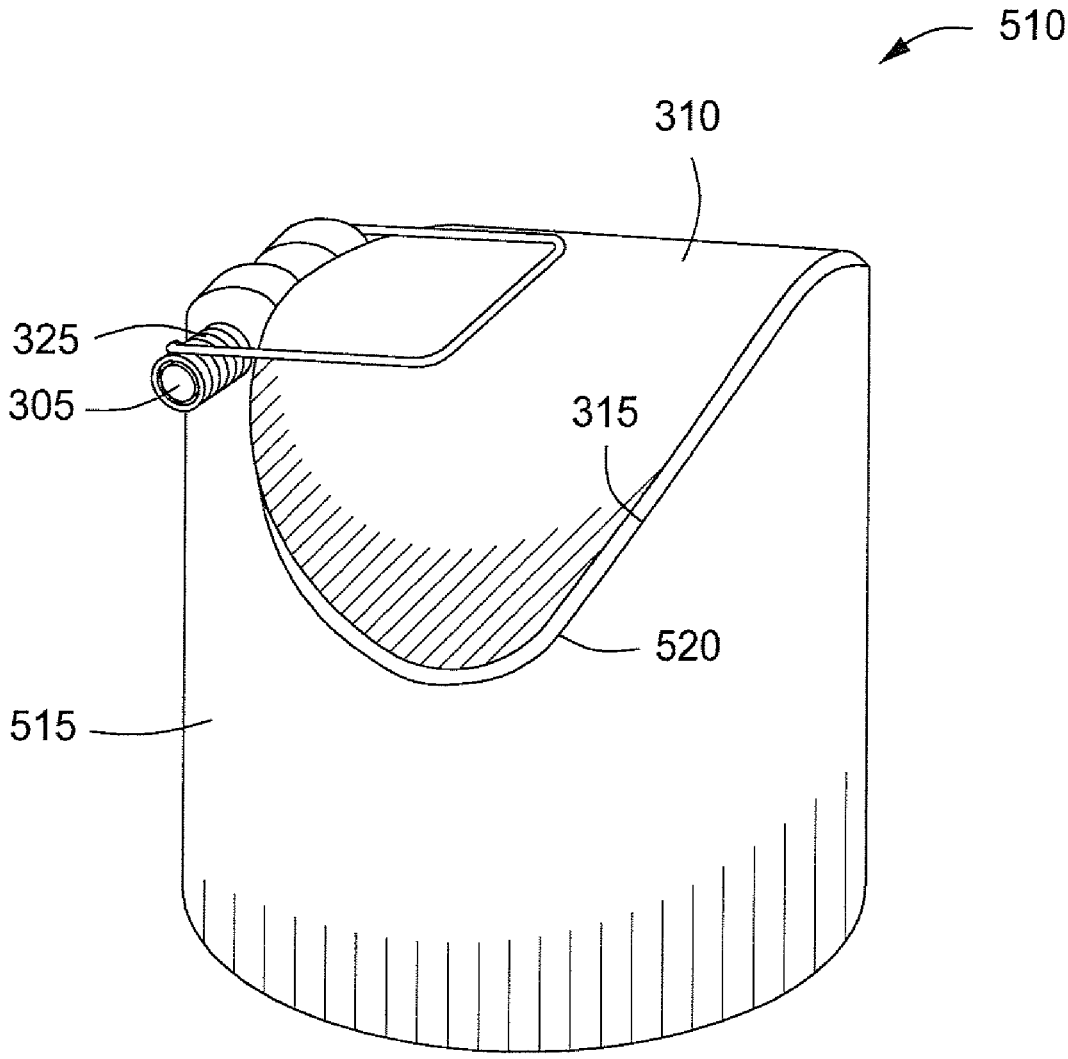
FIG. 8B depicts a 45 degree overhead orthogonal view of another illustrative valve assembly in the second, or operating, position according to one or more embodiments described

FIG. 8B depicts a 45 degree overhead orthogonal view of another illustrative valve assembly 510 in the second, or operating, position according to one or more embodiments. In one or more embodiments, when in the operating position, the valve member 310, urged by the one or more springs 325, can pivot about the pivot pin 305 to a position wherein the sealing surface 315 is proximate to the valve seat 520, forming a liquid tight seal therebetween. In the operating position, the valve member 310 is transverse to the longitudinal centerline of the tool 500, permitting only unidirectional fluid communication through the tool.

In operation, in the run-in position depicted in FIG. 5 and FIG. 5A, the valve member 310 remains trapped in the annular region 138 formed between the lower portion 176 of the sliding sleeve 170 and the valve body 130. While the sliding sleeve 170 is maintained in the run-in position, production fluids, hydrocarbons and/or downhole tools can pass bi-directionally through the open bore of the tool 100. While in the run-in position, the lower end 176 of the sliding sleeve 170 can be disposed within the bore formed by the valve assembly 510 thereby preventing liquids or other debris from entering the annular region 138, protecting both the valve member 310, pivot pin 305 and valve seat 520 from chemical and/or mechanical damage.

In one or more embodiments, any conventional downhole shifting tool can be used to apply an axial force to the sliding sleeve 170 sufficient to shear the one or more shear pins 140 and axially displace the sleeve uphole to the operating position depicted in FIG. 6. When the sliding sleeve reaches the operating position, the valve member 310 can freely pivot to the operating position proximate to the valve seat 520. In the operating position, higher pressure on the upper surface of the valve member 310 will tend to seat the valve member 310 more tightly against the valve seat 520, thus preventing fluid communication in a downward direction through the tool 500. The presence of a higher pressure on the lower surface of the valve member 310 will tend to lift the valve member 310 away from the valve seat 520, thereby permitting fluid communication in an upward direction through the tool 500.

Figure 9:
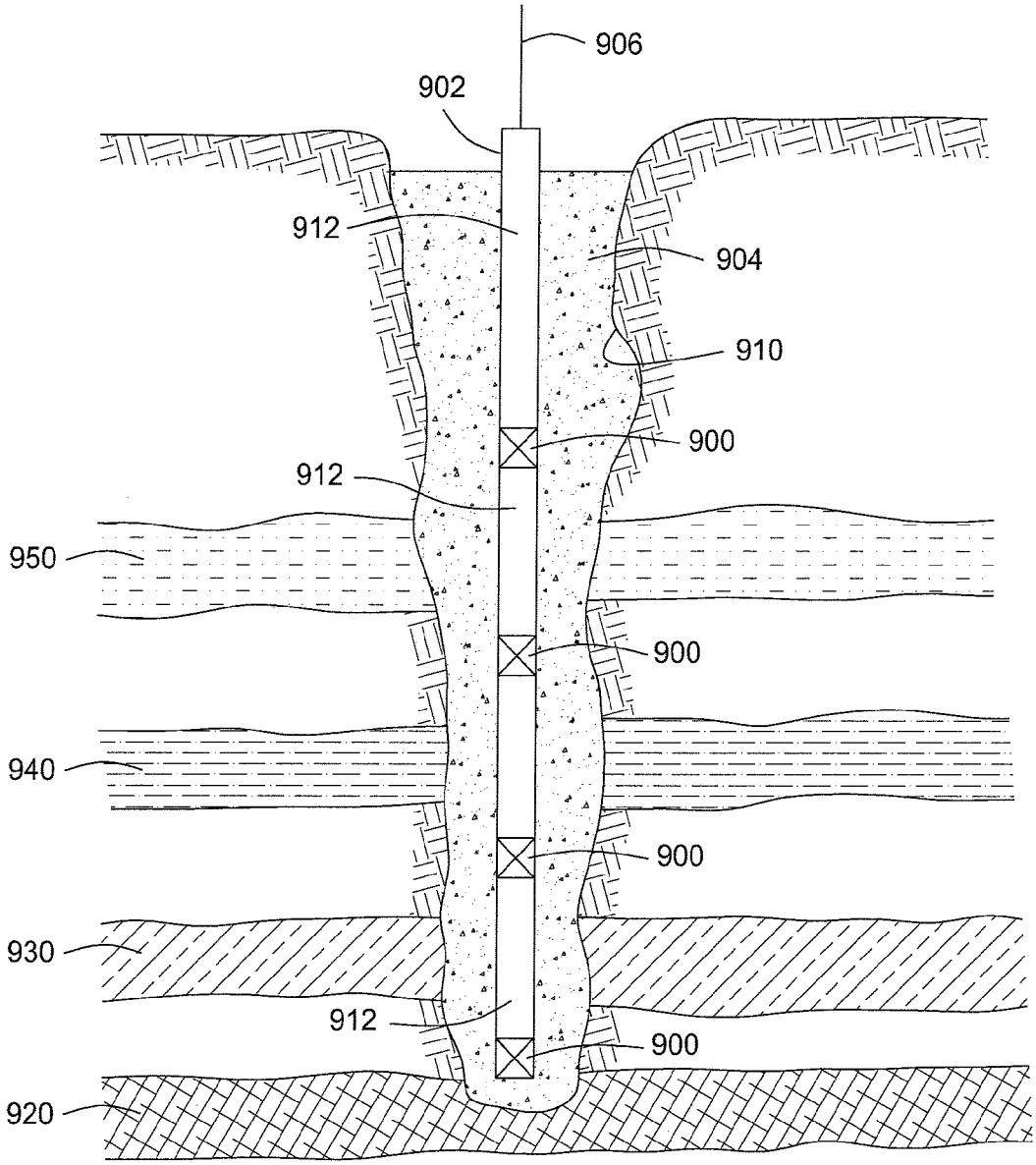
FIG. 9 depicts one or more illustrative tools disposed within a wellbore penetrating multiple hydrocarbon bearing intervals according to one or more embodiments described.

FIG. 9 depicts one or more illustrative tools 900 disposed within a wellbore 910 penetrating multiple hydrocarbon bearing intervals 920, 930, 940, 950, according to one or more embodiments. One or more tools 900 can be located along the string 902 enabling the independent isolation and testing of individual hydrocarbon bearing intervals within the wellbore 910. The outside diameter of the one or more tools 900 can be equal to the outside diameter of the tubular and/or casing string into which the tools 900 are inserted. While inserting the casing string 902 into the wellbore 910, all of the tools 900 can be in the run-in position thereby permitting bi-directional fluid communication along the entire length of the wellbore 910. Since the bores of the one or more tools 900 are open while in the run-in position, upward and downward passage of one or more tools and/or one or more production fluids through the tools 900 for example, cement used to form a sheath 904 about the casing string to seal the wellbore 910 can be accomplished.

The tool 900 can interchangeably denote the tool 100 as discussed and described in detail with respect to FIG. 1 or the tool 500 as discussed and described in detail with respect to FIG. 5. The tools 100, 500, as depicted in FIG. 9, can be distributed along the casing string 912 in any number, order and/or frequency. For example, the tools 100 and 500 can be alternated along the casing string 912. Optionally, one or more tools 100 can be disposed along a first portion of the casing string 912 while one or more tools 500 are disposed along a second portion of the casing string 912.

After curing, the cement sheath 904 the lowermost hydrocarbon bearing zone 920 can be fractured and produced by pumping frac slurry at very high pressure into the casing string 902. The hydraulic pressure exerted by the frac slurry can fracture the cement sheath 904 at the bottom of the casing string 902, permitting the frac slurry to flow into the surrounding hydrocarbon bearing zone 920. The well 906 can then be placed into production, with hydrocarbon flowing from the lowest hydrocarbon bearing interval 920 to the surface via the unobstructed casing string 902.

To frac and/or stimulate the next hydrocarbon bearing zone 930, a downhole shifting tool (not shown) can be inserted by wireline (also not shown) into the casing string 902. The shifting tool can be used to shift the sliding sleeve in the lowermost tool 900 located above hydrocarbon bearing zone 920 from the first "run-in" position to the second "operating" position, thereby deploying the valve member 310 transverse to the tool 900. In the operating position, uphole flow (i.e. upward flow of hydrocarbons from interval 920) through the lowermost tool 100, 500 can occur, however downhole flow through the tool 900 is prevented. The integrity of the casing string 902 and lowermost tool 100 can be tested by introducing a hydraulic pressure to the casing string 902 and evaluating the structural integrity of the casing string 902 and the lowermost tool. Similarly, perforation, and the addition of one or more frac-slurries and/or proppants can also be achieved without affecting the previously fraced, downhole, interval 920. Likewise, the one or more successive tools 900 located above hydrocarbon bearing intervals 930, 940 and 950 can be successively shifted and tested using conventional shifting tools, testing and fracing techniques.

In one or more embodiments, when the valve member is in the operating position, uphole well debris can accumulate on top of the valve member 310, thereby interfering with the operation of the valve member 310. Generally, sufficient downhole pressure will lift the valve member 310 and flush any accumulated debris upward through the casing string 902. In such instances, the well 906 can be placed into production without any further costs related to cleaning debris from the well.

However, debris accumulation on top of the valve member 310 can on occasion render the valve member inoperable, thereby preventing fluid flow through the tool 900 in either direction. Where the valve member 310 has been rendered thus inoperable, fluid communication through the tool 900 can be restored by fracturing, or otherwise removing or compromising the valve member 310; for example through the use of an appropriate solvent for a decomposable valve member 310, or through the use of a drop bar inserted via wireline for a frangible valve member.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A downhole tool comprising:

a body having a bore formed therethrough and at least one end adapted to threadably engage one or more tubulars;

a sliding sleeve at least partially disposed in the body, the sliding sleeve adapted to move between a first position and a second position within the body;

a valve assembly comprising a valve member having an arcuate cross section wherein the valve member is adapted to pivot between an open and closed position within the body; and a valve seat disposed in the body, the valve seat having a complimentary arcuate cross-section adapted to provide a fluid tight seal with the valve member, wherein an interface between the valve member and the valve seat, in the closed position, is angled relative to the longitudinal centerline of the body, such that, proceeding radially outward, the interface extends away from a vertex of the arcuate cross section of the valve member, and wherein the angle of the interface is between 1 degree and 89 degrees relative to the longitudinal centerline of the body.

2. The tool of claim 1, wherein the sliding sleeve in the first position maintains the valve member in the open position.

3. The tool of claim 2, wherein the valve member is disposed between the sliding sleeve and the body and wherein at least a portion of the sliding sleeve is disposed concentrically within the valve seat.

4. The tool of claim 1, wherein the sliding sleeve in the second position permits the valve member to pivot to the closed position.

5. The tool of claim 1, wherein the valve member is constructed of a frangible material.

6. The tool of claim 1, wherein the valve member is constructed of a material selected from the group consisting of cast iron, cast aluminum, and ceramic.

7. The tool of claim 1, wherein the valve member is constructed of a material soluble in a solvent selected from the group consisting of water, organic acids, inorganic acids, organic bases, inorganic bases, and organic solvents.

8. The tool of claim 1, further comprising a pivot pin and helical extension spring, wherein the helical extension spring urges the valve member from the open position to the closed position.

9. The tool of claim 1, wherein the valve member pivots along an arc of from about 85 degrees to about 95 degrees between the open and closed positions.

10. The tool of claim 1, further comprising a hinge extension that is integral to the valve seat, wherein the valve member is pivotally coupled to the hinge extension.

11. The tool of claim 1, further comprising a valve holder including an annular section disposed in the body and a hinge extension extending from the annular section, wherein the annular section is fixedly coupled to the valve seat and the valve member is pivotally coupled to the hinge extension.

12. The tool of claim 1, further comprising a sheer pin received by the sliding sleeve and the body when the sliding sleeve is in the first position, wherein the sheer pin is configured to temporarily maintain the sliding sleeve in the first position.

13. A downhole tool comprising:

a body having a bore formed therethrough and at least one end adapted to threadably engage one or more tubulars;

a valve assembly comprising a valve member having an arcuate cross section, wherein the valve member is adapted to pivot between an open position and a closed position within the body, wherein the valve assembly incorporates an integral valve seat having a complimentary arcuate cross section adapted to provide a fluid tight seal with the valve member; and a sliding sleeve at least partially disposed in the body, the sliding sleeve adapted to move between a first position and a second position within the body, wherein the sliding sleeve in the first position maintains the valve member in the open position, and wherein the sliding sleeve in the second position permits the valve member to pivot to the closed position, wherein an interface between the valve member and the valve seat, in the closed position, is angled relative to the longitudinal centerline of the body, such that, proceeding radially outward, the interface extends away from a vertex of the arcuate cross section of the valve member, and wherein the angle of the interface is between 1 degree and 89 degrees relative to the longitudinal centerline of the body.

14. The tool of claim 13, wherein the valve member is constructed of a frangible material.

15. The tool of claim 14, wherein the frangible material is a material selected from the group consisting of cast iron, cast aluminum, and ceramic.

16. The tool of claim 13, wherein the valve member is constructed of a compound soluble in a solvent selected from the group consisting of water, organic acids, inorganic acids, organic bases, inorganic bases, and organic solvents.

17. The tool of claim 13, further comprising a hinge extension that is integral to the valve seat, wherein the valve member is pivotally coupled to the hinge extension.

18. The tool of claim 13, further comprising a valve holder including an annular section disposed in the body and a hinge extension extending from the annular section, wherein the annular section receives the valve seat at least partially therein and the valve member is pivotally coupled to the hinge extension.

19. A method for testing a well, comprising:

installing a casing string within a wellbore, the string comprising one or more sections of casing and one or more tools wherein each tool comprises:

a body having a bore formed therethrough and at least one end adapted to threadably engage one or more tubulars;

a valve assembly comprising a valve member having an arcuate cross section wherein the valve member is adapted to pivot between an open and closed position within the body;

a sliding sleeve at least partially disposed in the body, the sliding sleeve adapted to move between a first position and a second position within the body wherein the sliding sleeve in the first position maintains the valve member in the open position and wherein the sliding sleeve in the second position permits the valve member to pivot to the closed position;

a valve seat disposed in the body, the valve seat having a complimentary arcuate cross-section adapted to provide a fluid tight seal with the valve member, wherein an interface between the valve member and the valve seat, in the closed position, is angled relative to the longitudinal centerline of the body, such that, proceeding radially outward, the interface extends away from a vertex of the arcuate cross section of the valve member, and wherein the angle of the interface is between 1 degree and 89 degrees relative to the longitudinal centerline of the body;

stabilizing the wellbore by passing cement through the casing string, said cement filling an annular region between the casing swing and the wellbore;

pressure testing the casing swing using a hydraulic or pneumatic test fluid;

fracturing the cement surrounding the casing swing using hydraulic pressure, wherein the fracture occurs proximate to a hydrocarbon bearing interval;

displacing the sliding sleeve in a tool, thereby permitting the valve assembly in the tool to move to a second position; and pressure testing the casing string above the tool using a hydraulic or pneumatic test fluid.

20. The tool of claim 19, wherein the valve seat is integral to the valve assembly.

* * * * *